US006164180A

United States Patent [19]

Sulm et al.

[11] Patent Number: 6,164,180

[45] Date of Patent: Dec. 26, 2000

[54] CONTAINER FOR BELTED AMMUNITION

[75] Inventors: Gunter Sulm, Vienna; Karl Brichta, Ebergassing, both of Austria

[73] Assignee: Steyr-Daimler-Puch Aktiengesellschaft, Vienna, Austria

[21] Appl. No.: 09/197,295

[22] Filed: Nov. 20, 1998

[30] Foreign Application Priority Data

Nov. 21, 1997 [AT] Austria ..... 1976/97

[51] Int. Cl.[7] ..... F41A 9/00

[52] U.S. Cl. ..... 89/33.16; 89/33.04; 89/33.14; 89/34

[58] Field of Search ..... 89/33.01, 33.1, 89/33.14, 33.5, 35.01, 33.16, 33.04, 34

[56] References Cited

U.S. PATENT DOCUMENTS

| | | | |
|---|---|---|---|
| 396,523 | 1/1889 | Accles | 89/34 |
| 1,790,867 | 2/1931 | Jervey | 89/33.16 |
| 2,470,475 | 5/1949 | Diaper . | |
| 2,710,561 | 6/1955 | Dowd . | |
| 4,263,837 | 4/1981 | Tassie . | |
| 4,494,440 | 1/1985 | Koine | 89/33.04 |
| 4,681,019 | 7/1987 | Brandl et al. | 89/33.04 |
| 5,097,742 | 3/1992 | Gaye et al. . | |
| 5,149,909 | 9/1992 | Hagen et al. | 89/33.16 |
| 5,684,265 | 11/1997 | Strasser et al. | 89/33.14 |

*Primary Examiner*—Charles T. Jordan
*Assistant Examiner*—Michelle Thomson
*Attorney, Agent, or Firm*—Bachman & LaPointe, P.C.

[57] ABSTRACT

In a container for belted ammunition, this ammunition forms loops between intermediate walls, thus ensuring that the ammunition can easily be drawn out, that the belted ammunition is supported vertically on the base, and a wall has a vertical aligned outlet opening for the belted ammunition, and that the base has a low-friction plastic covering.

10 Claims, 4 Drawing Sheets

CONTAINER FOR BELTED AMMUNITION

BACKGROUND OF THE INVENTION

The present invention relates to a container for belted ammunition, wherein the ammunition forms loops between intermediate walls, the container having a base and walls. Such containers are used for relatively large-caliber rapid-firing weapons, predominantly, but not exclusively, in combat vehicles. In vehicles such as these, as much ammunition as possible must be accommodated in as space-saving a manner as possible in order that the belt can be pulled out of the container easily.

A container of this generic type has been disclosed in DE 31 16 073 A1. However, in the case of this container, the ammunition loops hang between partition walls and the container must be moved to allow pulling out, to the extent that the individual loops are pulled out. The foregoing necessitates an additional drive and dedicated synchronization and control devices for this drive. Furthermore, the hanging arrangement necessitates considerable and greatly varying forces during the pulling out process.

It is the principle object of the invention to design a container of this generic type which ensures that the ammunition can be pulled out easily.

SUMMARY OF THE INVENTION

The foregoing object is achieved, according to the invention, wherein the belted ammunition is supported vertically on the base in the container, and one wall has a vertically aligned outlet opening for the belted ammunition. In consequence, the withdrawal forces are considerably less and more uniform, as it has been possible to verify in trials. These small withdrawal forces allow the belt to be pulled out of a fixed position opening despite the container being stationary, although the belted ammunition must in this case be pulled past the exposed cartridges which form the other loops.

In one particularly advantageous embodiment, the base has a low-friction plastic covering. This further reduces the force required to pull the ammunition out. As a result, in many cases it is possible to dispense with a sprocket wheel, and the weapon loading mechanism can overcome the friction that has been reduced in this way.

In another embodiment, a sprocket wheel is provided at the outlet opening in order to pull the belted ammunition out of the container. The sprocket wheel and its drive can be of very light construction, owing to the low forces. A removable cover is advantageously provided, to simplify loading.

The direction of the intermediate walls can be matched to the physical characteristics and the arrangement in the vehicle. If the intermediate walls are arranged parallel to the side walls, the withdrawal forces when the container is full, that is to say when firing starts, are at their lowest.

During operation in combat vehicles, when the inclination angle is severe, there is a risk of the individual belt sections being displaced. This is prevented by the intermediate walls having, on one side, horizontal guides with semicircular recesses and rounded transitions. The fact that the guides are arranged and rounded on only one side—namely on the belt section of a loop which is drawn out from the rear to the front—means that they prevent the cartridges from sliding, but without impeding withdrawal.

In a further advantageous development, the intermediate walls have guide rollers at their free end. The foregoing makes it easier to pull the belted ammunition out, particularly when the respective loop is a long way away from the outlet opening.

BRIEF DESCRIPTION OF THE DRAWINGS

The present invention will be described and explained in the following text with reference to figures, wherein.

DETAILED DESCRIPTION

Figure 1:
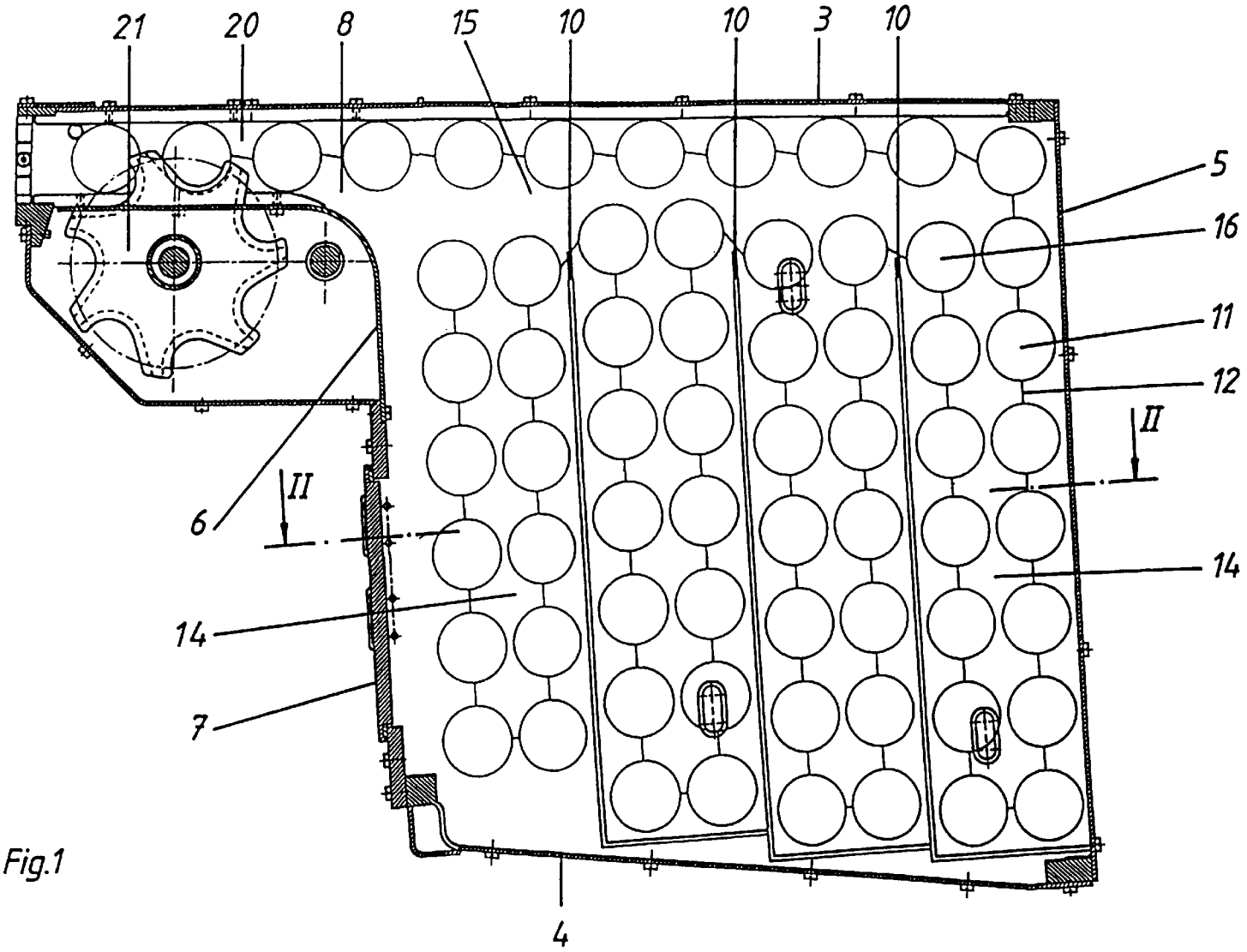
FIG. 1 shows a horizontal section through a first exemplary embodiment.
Figure 2:
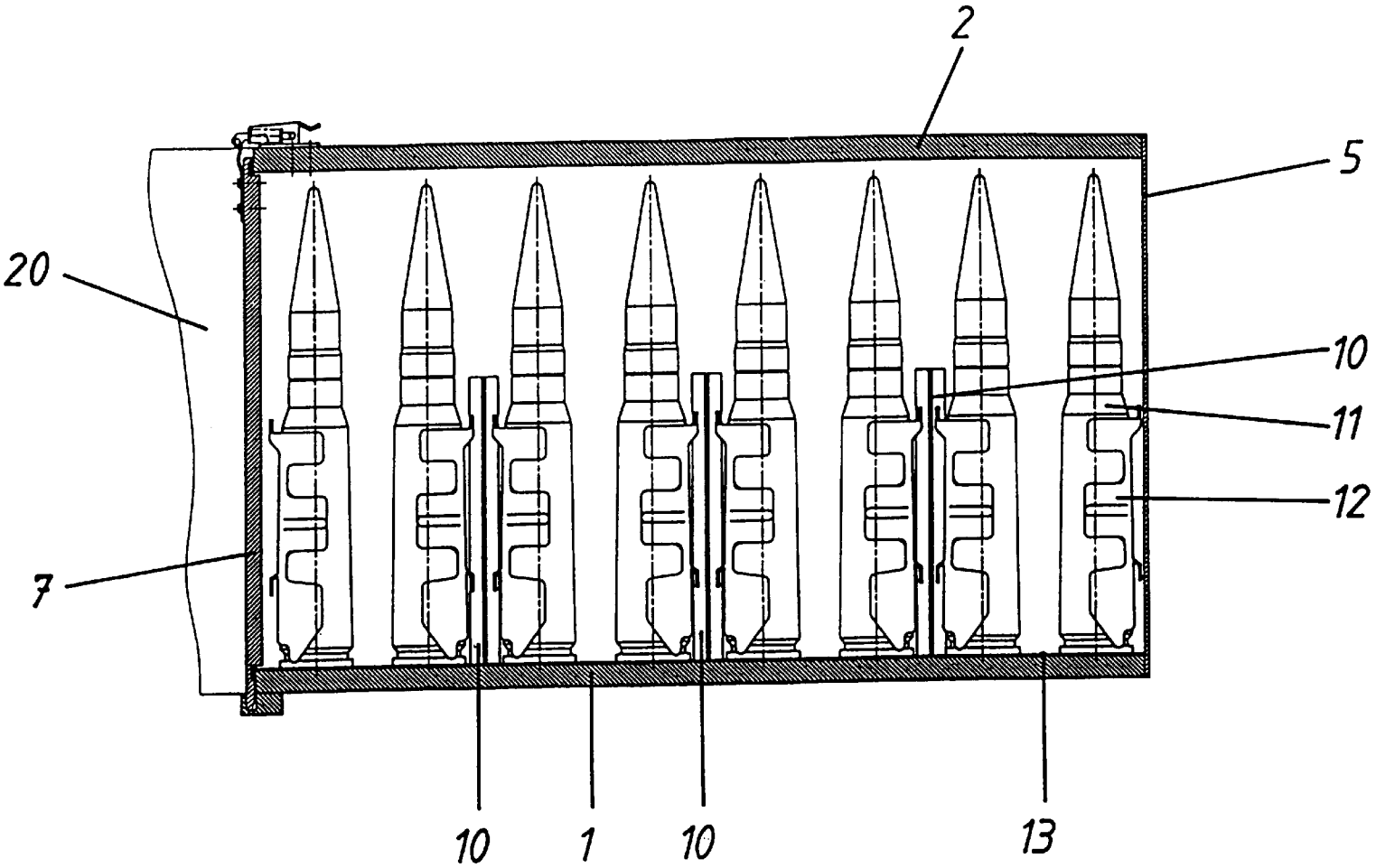
FIG. 2 shows a vertical section along II—II in FIG. 1.

The container according to the invention and illustrated in FIGS. 1 and 2 is an essentially cuboid metal structure. It comprises a base 1, a top wall 2 (see FIG. 2), first and second side walls 3, 4, a rear wall 5 and a front wall 6 with a removable cover 7. A vertical outlet opening 8 is formed on the front wall 6, adjacent to the first side wall 3. Vertical intermediate walls, which are attached to the base 1, are provided in the space formed in this way.

The individual cartridges 11 are supported vertically in this container and connected by links 12 of a belt. Owing to the intermediate walls 10 and the relatively dense packaging, there is no risk of the individual cartridges falling over. In order to simplify withdrawal, the base 1 is provided with a low-friction plastic covering 13. The belted cartridges 11 are inserted such that they form loops 14 between the individual intermediate walls 10, such that the loop furthest away from the outlet opening 8 is pulled out first. FIG. 1 shows that the belted ammunition forms a withdrawal section 15 from the rearmost loop to the outlet opening 8. The vertical arrangement of the individual cartridges and the low friction of the plastic covering 13 ensure that the withdrawal section 15 is impeded only slightly by the exposed cartridge 16.

In the illustrated exemplary embodiment, the vertical outlet opening 8 also has adjacent to it a withdrawal channel 20 in which a sprocket wheel 21 is fitted. Such a sprocket wheel could be required if the belt still has to travel a relatively long distance to the weapon.

Figure 3:
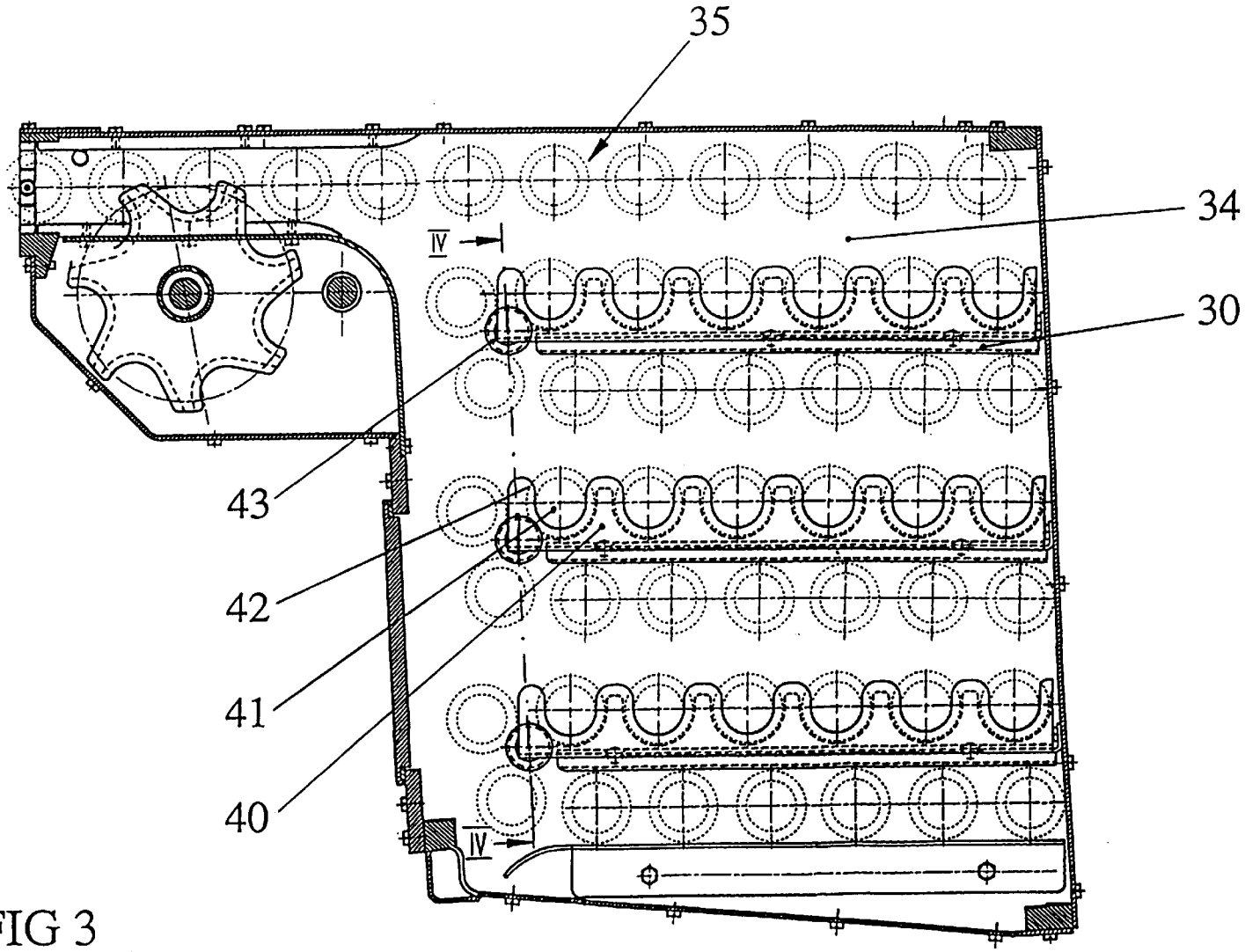
FIG. 3 shows a horizontal section through a second exemplary embodiment.
Figure 4:
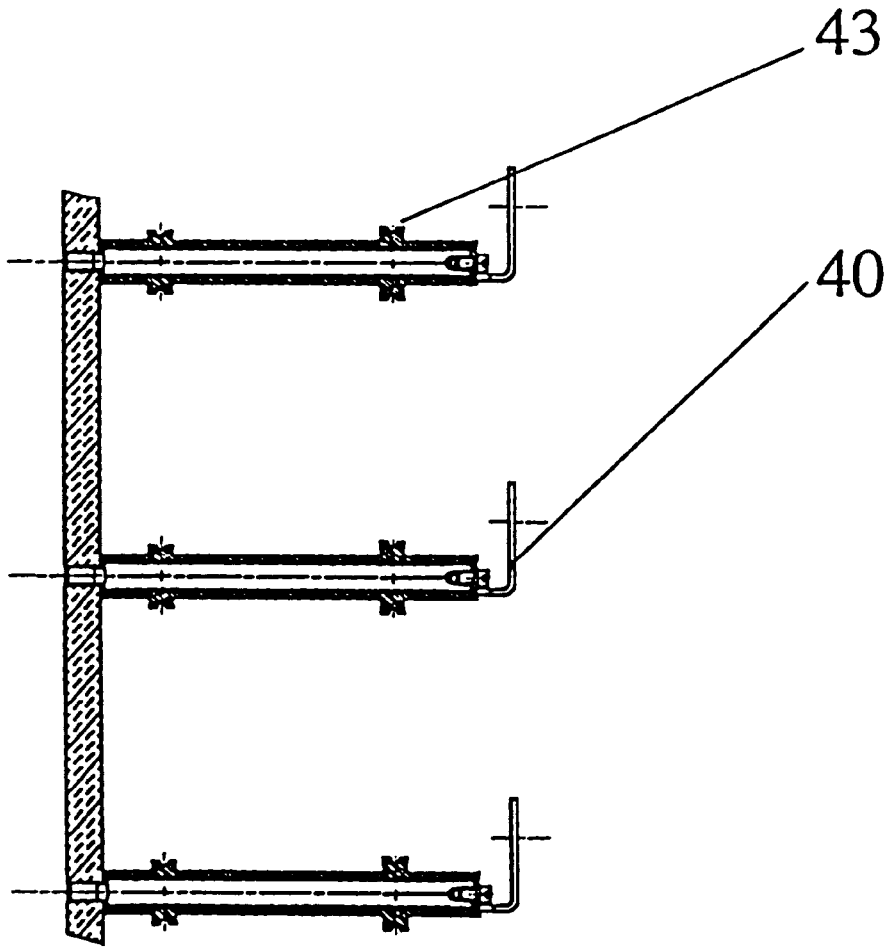
FIG. 4 shows a vertical section along IV—IV in FIG. 3.

The embodiment illustrated in FIGS. 3 and 4 is different to the previous embodiment in that the intermediate walls 30 are arranged parallel to the direction of the withdrawal section 35. The belt is pulled out in a straight-line continuation of the first loop 34. In order to prevent the belted ammunition from sliding when in an inclined position or when driving on a grade, guides 40 are attached to one side of the intermediate walls 30, and their recesses 41 partially surround the cartridges. The guides 40 are fitted only on that side of the intermediate wall on which the belted ammunition is drawn out from the rear to the front. The recesses 41 have rounded sections 42 in order not to impede the withdrawal of the belt. Rollers 43 are provided for the same purpose on the free ends of the intermediate walls 30. They act as guide rollers.

The ammunition container according to the invention is particularly suitable for installation in the turret of a combat vehicle, in which case the individual cartridge can be changed from the vertical position to the horizontal position in a known manner in a corresponding guide channel.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A container for belted ammunition wherein the belted ammunition is stored in loops in the container comprising:

wall means for defining an internal compartment for receiving the looped belted ammunition, said wall means includes a base and a side wall connected to the base wherein the belted ammunition is supported vertically on the base, said side wall having a front wall having a vertically extending outlet opening substantially perpendicular to the front wall for drawing the belted ammunition from the internal compartment, and intermediate wall means arranged in the internal compartment of the container and extending substantially vertically from the base for forming sub-compartments therebetween for receiving at least one loop of the belted ammunition.

2. A container according to claim 1, wherein the intermediate wall means comprises a plurality of walls arranged substantially parallel to and spaced from each other and extending substantially perpendicular from the base.

3. A container according to claim 1, wherein the base supports the ammunition vertically for passing the ammunition through said vertically extending outlet.

4. The container according to claim 3, wherein the portion of the base supporting the belted ammunition is formed of a low-friction plastic material.

5. The container according to claim 1, wherein a drive means is provided at the outlet opening for drawing out the belted ammunition.

6. The container according to claim 5, wherein the drive means comprises a sprocket wheel.

7. The container according to claim 1, wherein the side wall has a removable cover.

8. The container according to claim 1, wherein the intermediate walls are provided with, at least on one side, guides for the belted ammunition which comprise semicircular recesses with rounded transitions.

9. The container according to claim 1, wherein each of the intermediate walls has a free end and a guide roller is provided on the free end.

10. The container according to claim 1, wherein said side wall has a back wall, wherein the sub-compartments are sequentially spaced from said back wall to said front wall and the ammunition belt is drawn from the sub-compartments from the back wall to the front wall.

* * * * *